US009634387B2

(12) United States Patent
Cozzolino

(10) Patent No.: US 9,634,387 B2
(45) Date of Patent: Apr. 25, 2017

(54) MULTIPLE-INPUT MULTIPLE-OUTPUT (MIMO) ANTENNA

(71) Applicant: Galtronics Corporation Ltd., Tiberias (IL)

(72) Inventor: Randell Cozzolino, Upper Tiberias (IL)

(73) Assignee: Galtronics Corporation Ltd., Tiberias (IL)

( * ) Notice: Subject to any disclaimer, the term of this patent is extended or adjusted under 35 U.S.C. 154(b) by 0 days.

(21) Appl. No.: 15/041,534

(22) Filed: Feb. 11, 2016

(65) Prior Publication Data

US 2016/0240930 A1 Aug. 18, 2016

Related U.S. Application Data

(60) Provisional application No. 62/115,202, filed on Feb. 12, 2015.

(51) Int. Cl.

| | |
|---|---|
| ***H01Q 1/52*** | (2006.01) |
| ***H01Q 9/28*** | (2006.01) |
| ***H01Q 19/24*** | (2006.01) |
| ***H01Q 21/28*** | (2006.01) |
| *H01P 5/10* | (2006.01) |

(52) U.S. Cl.

CPC ..... *H01Q 1/521* (2013.01); *H01Q 9/285* (2013.01); *H01Q 19/24* (2013.01); *H01Q 21/28* (2013.01); *H01P 5/10* (2013.01)

(58) Field of Classification Search

CPC ..... H01Q 1/523; H01Q 21/062

See application file for complete search history.

(56) References Cited

U.S. PATENT DOCUMENTS

| | | | | |
|---|---|---|---|---|
| 2005/0057407 | A1* | 3/2005 | Imaizumi | H01Q 9/42 343/702 |
| 2009/0322648 | A1* | 12/2009 | Bishop | H01Q 21/20 343/893 |
| 2011/0175792 | A1* | 7/2011 | Yoon | H01Q 1/521 343/893 |
| 2012/0274532 | A1* | 11/2012 | Kurashima | H01Q 1/243 343/833 |
| 2013/0234896 | A1* | 9/2013 | Sharawi | H01Q 9/0421 343/700 MS |
| 2013/0257674 | A1* | 10/2013 | Li | H01Q 5/321 343/853 |
| 2015/0097751 | A1* | 4/2015 | Hsu | H01Q 21/28 343/844 |

* cited by examiner

*Primary Examiner* — Graham Smith
*Assistant Examiner* — Daniel J Munoz
(74) *Attorney, Agent, or Firm* — Lorenz & Kopf, LLP.

(57) ABSTRACT

A multiple input multiple output (MIMO) antenna is provided. The MIMO antenna may include, but is not limited to, a printed circuit board having a plurality of edges and a ground layer including, but not limited to a plurality of antenna element mounting locations, at least one of the plurality of antenna element mounting locations being arranged on a first side of the printed circuit board and at least one of the plurality of antenna element mounting locations being arranged on a second side of the printed circuit board, a plurality of slots, each of the plurality of slots extending a predetermined distance from an edge of the printed circuit board, and at least one ground stub, the at least one ground stub comprising an extension of the ground layer of a predetermined electrical length at a predetermined angle relative to the edge of the printed circuit board.

20 Claims, 6 Drawing Sheets

130
410
420
430
430
440
400
124

MULTIPLE-INPUT MULTIPLE-OUTPUT (MIMO) ANTENNA

CROSS-REFERENCE TO RELATED APPLICATION(S)

This application claims the benefit of U.S. provisional patent application Ser. No. 62/115,202 filed Feb. 12, 2015, the entire content of which is incorporated by reference herein.

TECHNICAL FIELD

The present disclosure generally relates to antenna, and more particularly relates to multiple input multiple output antenna.

BACKGROUND

Modern devices, such as Wi-Fi routers, often utilize multiple antennas to improve a throughput of the device. However, when multiple antennas are mounted in close proximity, the antennas can interfere with one another, degrading the performance of the antennas.

BRIEF SUMMARY

In one embodiment, for example a multiple-input multiple-output antenna is provided. The multiple-input multiple-output antenna may include, but is not limited to, a printed circuit board having a plurality of edges, the printed circuit board comprising a ground layer. The ground layer may include, but is not limited to, a plurality of antenna element mounting locations, at least one of the plurality of antenna element mounting locations being arranged on a first side of the printed circuit board and at least one of the plurality of antenna element mounting locations being arranged on a second side of the printed circuit board, a plurality of slots comprising dielectric material in a plane of the ground layer, each of the plurality of slots extending a predetermined electrical length from an edge of the printed circuit board, and at least one ground stub, the at least one ground stub comprising an extension of the ground layer of a predetermined electrical length at a predetermined angle relative to the edge of the printed circuit board.

In another embodiment, for example, a communication device is provided. The communication device may include, but is not limited to, a printed circuit board having a plurality of edges, the printed circuit board comprising a ground layer. The ground layer may include, but is not limited to, a plurality of antenna element mounting locations, at least one of the plurality of antenna element mounting locations being arranged on a first side of the printed circuit board and at least one of the plurality of antenna element mounting locations being arranged on a second side of the printed circuit board, a plurality of slots comprising a dielectric material in a plane of the ground layer, each of the plurality of slots extending a predetermined electrical length from an edge of the printed circuit board, and at least one ground stub, the at least one ground stub comprising an extension of the ground layer of a predetermined electrical length at a predetermined angle relative to the edge of the printed circuit board. The communication device may further include a plurality of antenna elements, each of the plurality of antenna elements configured to couple to one of the plurality of antenna element mounting locations, a plurality of coupling elements, each coupling element formed from a conductive material, each coupling element having a predetermined electrical length and arranged at an edge of the printed circuit board across from one of the plurality of antenna element mounting locations, and at least one director, each director formed from a conductive material arranged in an L-shaped and located at a corner of the printed circuit board in the plane of the conductive ground layer, each director having a predetermined electrical length.

BRIEF DESCRIPTION OF THE DRAWINGS

The detailed description will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or detail of the following detailed description.

Figure 1:
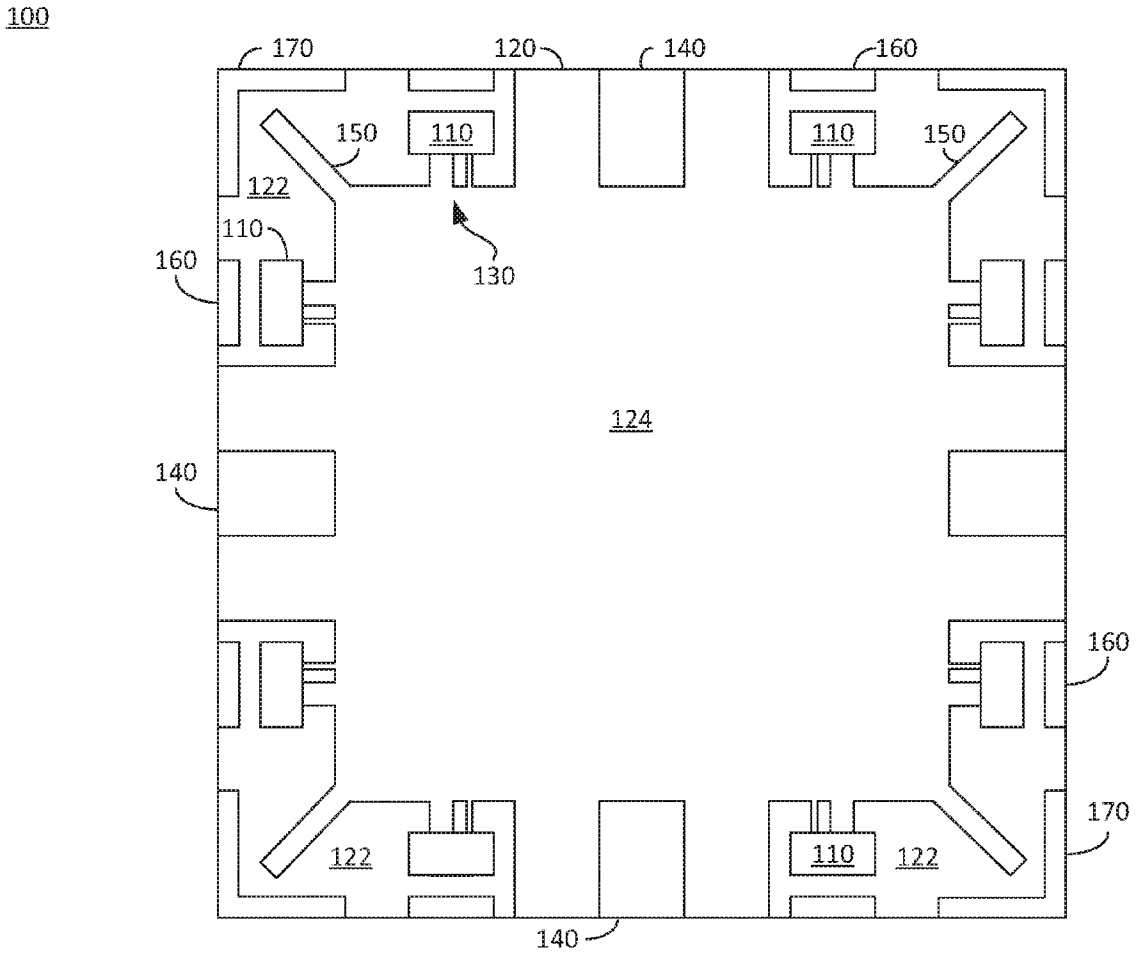
FIG. 1 illustrates an exemplary embedded MIMO antenna, in accordance with an embodiment.

FIG. 1 illustrates an exemplary embedded MIMO antenna 100, in accordance with an embodiment. The multiple-input multiple-output (MIMO) antenna 100 utilizes multiple antenna elements 110 to increase data throughput. The embedded MIMO antenna 100 may be used, for example, in a communication device such as a Wi-Fi router operating within a band defined by, for example, IEEE 802.11ac. In other embodiments, the MIMO antenna may be used within, for example, wireless video bridges, gaming consoles, and wireless set top boxes, or the like.

Each antenna element 110 is mounted on a printed circuit board (PCB) 120. The PCB 120 includes at least one insulative layer 122 and at least one conductive ground layer 124. While the exemplary embodiment illustrated in FIG. 1 illustrates the embedded MIMO antenna 100 as having eight antenna elements 110, the embedded MIMO antenna 100 could be arranged, for example, to have between two and eight antenna elements 110. In one embodiment, for example, each antenna element 110 may be a dipole antenna.

Figure 2:
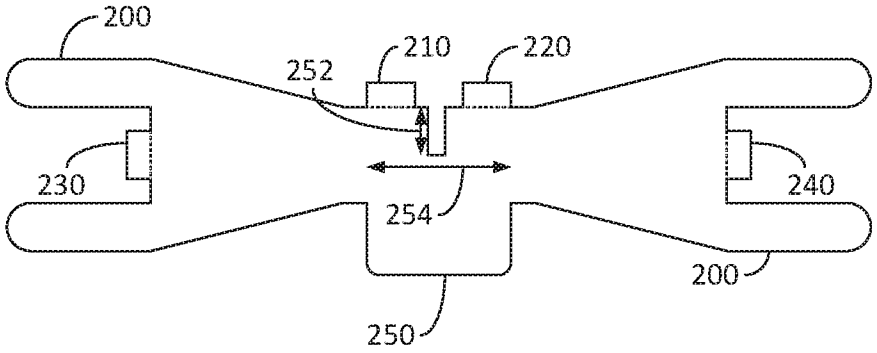
FIG. 2 illustrates on overhead view of an exemplary antenna element, in accordance with an embodiment.
Figure 3:
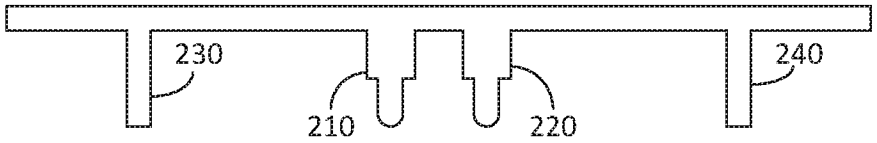
FIG. 3 illustrates a side view of the exemplary antenna element, in accordance with an embodiment.

FIG. 2 illustrates on overhead view of an exemplary antenna element 110 and FIG. 3 illustrates a side view of the exemplary antenna element 110, in accordance with an embodiment. The antenna element 110 illustrated in FIGS. 2 and 3 is arranged as a dipole antenna having dipole arms 200. The dipole arms 200 radiate within a frequency range based upon an electrical length of the dipole arms 200. When the antenna elements 110 are being used, for example, in a Wi-Fi router operating within a frequency band defined by IEEE 802.11ac, the electrical length of the dipole arms 200 may be selected such that the antenna elements 110 are ½ of a wavelength λ centered around the frequency band. For example, the distance between the dipole arms 200 of the antenna element 110 illustrated in FIGS. 2 and 3 may be twenty-two millimeters (mm). In this exemplary embodiment, the antenna element 110 would have a resonant frequency range of approximately 5.1-5.9 GHz.

The antenna element 110 includes four pins 210-240. Pins 210 and 220 are interchangeable feed pins. The pins 210 and 220 are interchangeable as either pin can serve as a signal feed pin or as a ground feed pin. In other words, when mounted to the PCB 120, one of the pins 210 and 220 would be connected to the ground layer 124 of the PCB 120 and the other of the pins 210 and 220 would be connected to a feed line, which is discussed in further detail below.

Pins 230 and 240 are optional pins and may be used to further improve the alignment of the antenna element 110 on the PCB 120. However, the feed pins 210 and 220 may be sufficient to properly align and secure the antenna element 110 on the PCB 120. When the pins 230 and 240 are used and installed within galvanically isolated holes within the PCB 120, the pins 230 and 240 can become dielectrically loaded by the PCB material. The portion of the dipole arms 200 where the pins 230 and 240 are located would have a longer electrical length than the portion of the dipole arms 200 in free space due to the dielectric loading on the pins 230 and 240 when the pins are inserted into the PCB 120. Accordingly, when the antenna element 110 includes the alignment pins 230 and 240 the antenna element 110 may have a wider bandwidth than an antenna element which does not include alignment pins 230 and 240.

In one embodiment, for example, the antenna element 110 may be formed from a single sheet of conductive material, such as copper, brass, tin or nickel plated steel, or the like. The pins 210-240 of the antenna element 110 may then be bent to form the shape seen in FIGS. 2 and 3.

When an dipole antenna is typically mounted on a PCB, the distance the antenna is mounted from the conductive layer of the PCB is typically ¼λ so that waves reflected off of the ground layer are in phase with the incident waves emanating from the antenna elements 110 and the radiated energy is collimated in a direction away from the ground layer on the PCB. Electromagnetic waves could be considered sine waves which have three properties frequency, amplitude, and phase. An electromagnetic wave will travel in a straight line until it is deflected by something. If the deflected wave is reflected back to the source (antenna) it will arrive at a certain amplitude and phase. If the reflected wave arrives at the source in phase with the incident wave the amplitude of the two signals will combined (amplitudes added together). If the reflected wave arrives at the source directly out of phase than the amplitude of the reflected wave is subtracted from the amplitude of the incident wave cancelling each other out. When the reflected wave is in phase with the incident wave the energy will combine (or collimate) in the direction that both waves are travelling, in this case away from the antenna and ground plane). In the embodiment illustrated in FIG. 1, each antenna element 110 is mounted less than ¼λ from the ground layer 124 of the PCB 120. In one embodiment, for example, the antenna elements 110 may be mounted two millimeters above the ground layer 124 of the PCB 120. One benefit of mounting the antenna element 110 closer than ¼λ from the ground layer 124 of the PCB 120 is that the overall size of the antenna device can be reduced. However, because the antenna element 110 is mounted less than ¼λ from the ground layer 124 of the PCB 120, the reflected waves would not be in phase with the incident waves which adversely affects the impedance of the antenna element 110. In order to match the impedance of the transmission line feeding the antenna element 110 and to compensate for the antenna element 110 being mounted closer than ¼λ from the ground layer 124 of the PCB 120, the antenna element 110 includes an integrated balun 250.

As best seen in FIG. 2, the balun 250 is substantially U-shaped and is located at a junction of the dipole arms 200 and the feed pins 210 and 220. As seen in FIGS. 2 and 3, the balun 250 is substantially orthogonal to the pins 210 and 220 when the pins 210 and 220 are bent and in the formation illustrated in the FIGS. Furthermore, the balun 250 provides a surface which a suction head of a component placement robot could use to pick up the antenna element 110 and place the antenna element 110 onto the PCB 120 during mass production.

As discussed above, the balun 250 alters the impedance of the antenna element 110 such that the impedance of the antenna element can match the feed line feeding the antenna element 110. As discussed above, the impedance of the antenna element 110 when installed in the PCB 120 is lowered due to the incident waves emanating from the antenna element 110 being out of phase with the reflected waves (i.e., the incident waves which bounce off the ground layer 124 of the PCB 120). By adjusting the depth of the U-shape portion of the balun 250 indicated by arrow 252 and the width of the balun 250 indicated by arrow 254, the electrical length of the balun 250 is altered, which in turn alters the impedance of the antenna element 110. In one embodiment, for example, the balun may be approximately ⅒λ (about 3 millimeters), but as discussed above, the size and shape of the balun 250 can be adjusted to alter the impedance of the antenna element 110.

Returning to FIG. 1, the antenna elements 110 are mounted on the PCB 120 at an antenna element mounting location 130 which is approximately ¼λ (about twenty-two millimeters in this example) from the corner of the PCB 120. The antenna element mounting location 130 may include a feed line for feeding a signal to the antenna element 110 and a ground input for providing a ground feed to the antenna element 110. In one embodiment, for example, the feed line may include a printed transmission line coupled to a radio unit (not illustrated) which provides an RF signal to the antenna element and an electrically conductive thru hole (hereinafter referred to as a plated-thru hole (PTH)) galvanically connected to the printed transmission line which a feed pin of an antenna element could be installed. However, in other embodiments, for example, a coaxial cable or the like may be used as the feed line.

Figure 4:
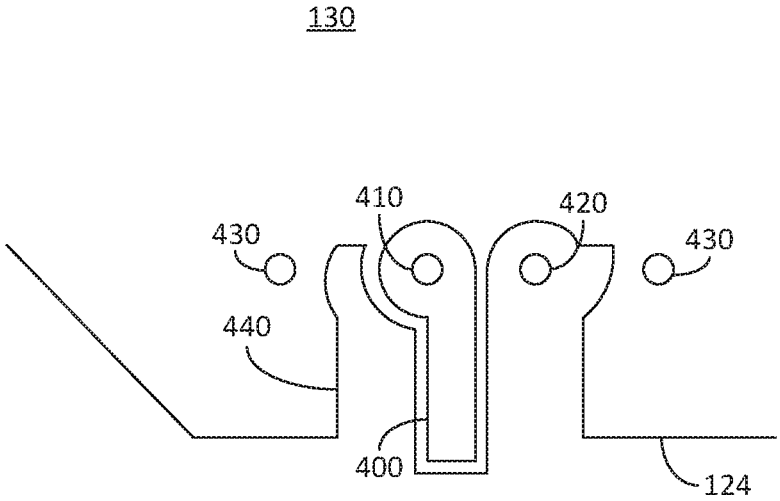
FIG. 4 illustrates an exemplary antenna element mounting location, in accordance with an embodiment.

FIG. 4 illustrates an exemplary antenna element mounting location 130, in accordance with an embodiment. The exemplary antenna element mounting location 130 illustrated in FIG. 4 includes a printed transmission line 400. The printed transmission line 400 may be coupled to a radio unit controlled by a controller to provide a RF signal to the antenna element 110 which causes the antenna element 110 to radiate. The printed transmission line 400 is galvanically coupled to a PTH 410. A pin of the antenna element 110, such as the pin 210 illustrated in FIGS. 2 and 3, may be inserted into the PTH 410 and soldered thereto to galvanically couple the antenna element 110 to the printed transmission line 400.

The antenna element mounting location 130 further includes a PTH 420 which is galvanically connected to the ground layer 124 of the PCB 120. A pin of the antenna element, such as the pin 220 illustrated in FIGS. 2 and 3, may be inserted into the PTH 420 and soldered thereto to galvanically couple the antenna element 110 to the ground layer 124 of the PCB 120 to thereby provide a ground feed to the antenna element 110.

While the printed transmission line 400 and the PTH 410 are illustrated as being on the left and the PTH 420 is illustrated as being on the right, their respective positions can be reversed such that the printed transmission line 400 and the PTH 410 would be on the right and the PTH 420 would be on the left. As discussed in further detail below, by changing the positions of the printed transmission line 400, the PTH 410 and the PTH 420, surface currents on the ground layer 124 of the PCB can be directed.

The antenna element mounting location 130 further includes two non-plated thru holes 430. The non-plated through holes 430 are galvanically isolated from the ground layer 124 of the PCB 120. Alignment pins, such as the alignment pins 230 and 240 illustrated in FIGS. 2 and 3, of an antenna element 110 may be installed within the non-plated thru holes 430. Utilizing the non-plated thru holes 430 may improve the consistency between the angle of the antenna elements 110 installed on the PCB 120. As seen, for example, in FIG. 1, antenna elements may be installed on the PCB 120 such that an angle between the antenna elements 110 is zero degrees (when the antenna elements 110 are on the same side of the PCB 120), ninety degrees (when the antenna elements 110 are adjacent on a corner the PCB 120), or one-hundred eighty degrees (when the antenna elements 110 are on the opposite side of the PCB 120). Consistent angles between the antenna elements 110 allow the MIMO antenna 100 to have vertical and horizontal polarization, which helps to limit interference between the antenna elements 110 of the MIMO antenna 100.

Returning to FIG. 4, the antenna element mounting location 130 further includes a ground coupling element 440. The ground coupling element 440 capacitively couples with the printed transmission line 400 in order to keep the feed pin (PTH 410) from radiating. The distance between the printed transmission line 400 and the ground coupling element 440 and the electrical length of the ground coupling element 440 affect the impedance of the antenna element 110 and the resonant frequency of the antenna element to a lesser extent. Accordingly, the electrical length of the ground coupling element 440 and the distance between the printed transmission line 400 and the ground coupling element 440 can be adjusted. In the embodiment illustrated in FIG. 4, for example, the distance between the printed transmission line 400 and the ground coupling element 440 may be 0.5 mm and the electrical length of the ground coupling element 440 may be approximately ⅛λ. However, the respective measurements can be altered depending upon a desired capacitive coupling between the printed transmission line 400 and the ground coupling element 440.

Returning to FIG. 1, another issue with placing the antenna elements 110 less than ¼λ from the ground layer 124 of the PCB 120 is that the fields created by the antenna elements induce currents on the ground layer 124 of the PCB 120. These induced currents can radiate from the edges of the ground layer 124 in undesired directions and may couple to the antenna elements 110 impacting the isolation between the antenna elements 110. Accordingly, as seen in FIG. 1, the MIMO antenna further includes slots 140, ground stubs 150, coupling elements 160 and directors 170.

Figure 5:
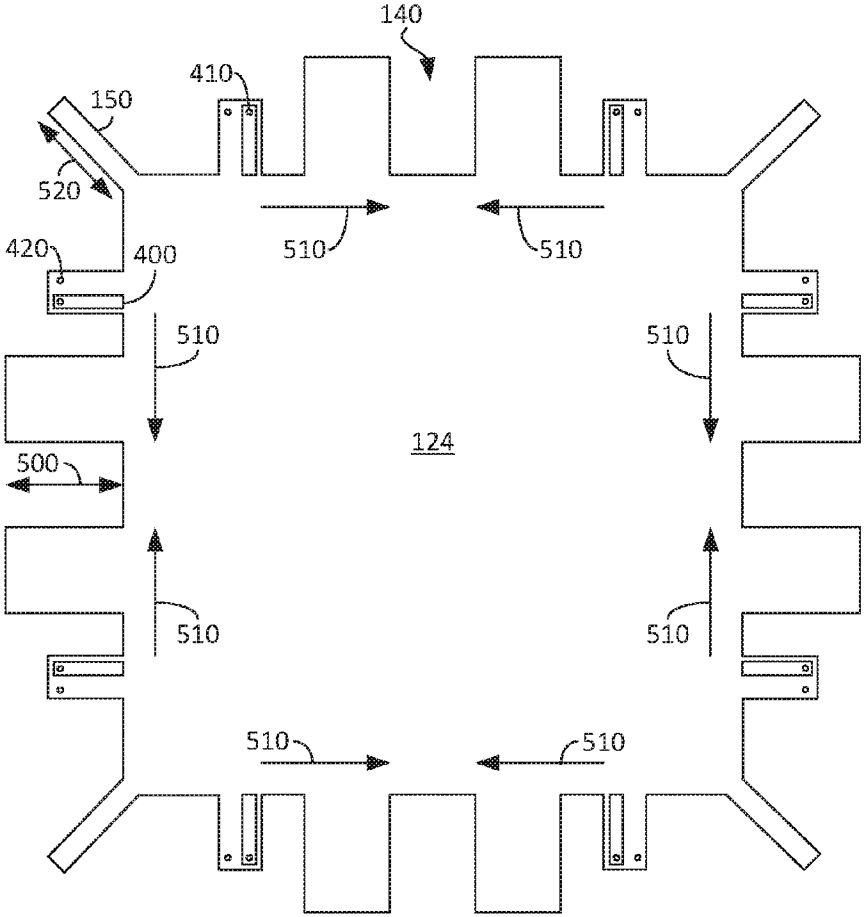
FIG. 5 illustrates just the ground layer of the PCB illustrated in FIG. 1.

The slots 140 are cutouts in the ground layer 124 of the PCB 120 which exposes the insulative layer 122 above or below the ground layer 124. The slot 140 may be filled with a dielectric material. For clarity, FIG. 5 illustrates just the ground layer 124 of the PCB 120 illustrated in FIG. 1. As seen in FIG. 5, the slot 140 extends a predetermined length from an edge of the PCB 120. In one embodiment, for example, the electrical length of the slot 140, indicated by arrow 500 in FIG. 5, may be ¼λ. In one embodiment, for example, the width of the slot may be five millimeters or greater. Because of the electrical length of the slot 140, the slot 140 is resonant in the intended band of operation. The surface current induced on the ground layer 124 of the PCB 120 by the antenna elements that are flowing in the direction of the slot 140 (i.e., in the direction of arrows 510) are radiated off the ground layer 124 thereby greatly reducing the amount of surface currents that would continue to flow on the edge of the PCB 120 toward the adjacent antenna element on the other side of the slot 140.

As discussed above, the position of signal feed pin and the ground feed pin (i.e., pins 210 and 220 illustrated in FIGS. 2 and 3) and the positions of the printed transmission line 400, the PTH 410 and the PTH 420 illustrated in FIG. 4 are interchangeable. Preferably, the printed transmission line 400 and the PTH 410 are arranged on the PCB 120 within the antenna element mounting locations 130 closest to an adjacent slot 140 and the position of the PTH 420 is arranged closest to an adjacent corner of the PCB 120 where the ground stubs 150 are located. The arrangement illustrated in FIG. 5 focuses the current induced on the ground layer 124 of the PCB 120 caused by the antenna elements 110 to travel towards the adjacent slot 140, as illustrated by arrows 510.

When the induced surface current illustrated by arrows 510 reach the slots 140, the slots 140 choke off the current. In other words, the slots 140 effectively reduce the surface current induced by the antenna elements. A portion of the current is radiated by the slots 140 due to the length of the slot being ¼λ. Another portion of the current is reflected back towards the corner of the PCB 120 where the ground stubs 150 are located. By reducing the surface current via the slots 140 between antenna elements 110 on the same side of the PCB 120, the RF isolation between the adjacent antenna elements 110 is increased. In other words, the slots 140 help prevent adjacent antenna elements 110 on a side of the PCB from coupling energy to each other.

As discussed above, the PCB 120 includes ground stubs 150. The ground stubs 150 are projections of the ground layer 124 of the PCB 120 between the antenna elements 110 at the corners of the PCB 120. As seen in FIG. 1, the ground stubs project at an angle of around forty-five degrees relative to an edge of the PCB 120. In one embodiment, for example, the ground stubs 150 may have an electrical length, as indicated by arrow 520, of around ¼λ. When current induced by the antenna elements reaches a ground stub 150 a portion of the current is radiated by the ground stub 150. Accordingly, like the slots 140, the ground stubs improve isolation between the antenna elements 110 adjacent to the ground stub 150 (i.e., the antenna elements on the corners of the PCB 120) by reducing the surface current induced on the ground layer 124 of the PCB 120 between the respective antenna elements.

The slots 140 and the ground stubs 150 also affect the gain pattern of the MIMO antenna 100. As discussed above, the antenna elements 110 induces strong surface currents onto the PCB 120. The currents flow on both sides of the antenna elements 110. The slots 140 suppress, reflect (towards the ground stubs 150), or cause to radiate surface currents that are traveling toward an adjacent antenna element. Accordingly, at least a portion of the surface current is radiated by the slot 140. Likewise, at least a portion of the surface current flowing from the antenna element 110 towards the ground stub 150 and surface current reflected by the slot 140 towards the ground stub 150 is radiated by the ground stub 150. Accordingly, the slots 140 and ground stubs 150 control the direction and subsequent radiation of the induced surface currents.

Returning to FIG. 1, as discussed above, the MIMO antenna 100 further includes coupling elements 160. Each coupling element 160 is arranged perpendicular to one of the outer edges of the PCB 120 and at one of the outer edges of the PCB 120 in the same plane as the ground layer 124 across from one of the antenna element mounting locations 130 (and, thus, an antenna element 110 when the antenna element is installed). Each coupling element 160 is separated from the antenna element mounting locations 130 by insulative material of the insulative layer 122. In one embodiment, for example, each coupling element 160 may be positioned such that when the antenna element 110 is installed, the coupling element 160 is one millimeter from the installed antenna element. The coupling element 160 may be formed from a conductive material including, but not limited to, copper. When the antenna element 110 proximate to a respective coupling element 160 radiates, the coupling element 160 capacitively couples to the antenna element 110. The capacitive coupling causes the coupling element 160 to radiate within a frequency range dependent upon an electrical length of the coupling element 160. In one embodiment, for example, the coupling element 160 may be sized such that an electrical length of the coupling element is approximately ½λ. The coupling elements 160 may increase a bandwidth of the MIMO antenna 100, thereby increasing the efficiency bandwidth of the MIMO antenna 100.

The MIMO antenna further includes at least one director 170. As seen in FIG. 1, each director 170 is L-shaped and located at a corner of the PCB 120 in the same plane as the ground layer. The director(s) 170 may be formed from a conductive material including, but not limited to, copper. The director(s) 170, like the ground stubs 150, improves the isolation between the antenna elements 110 adjacent to the respective director 170. The director 170 increases the directivity of the antenna by guiding, or directing, the electromagnetic waves that are radiating off of the corner stub 150 so that the electromagnetic waves continue propagating away from the corner of the PCB 120 thereby reducing the amount of energy that could otherwise propagate towards the adjacent antenna. As illustrated in the FIGS., there are two antenna elements proximate to each corner of the PCB 120. Both antenna elements 110 are directing the induced surface waves toward the corner of the PCB 120. Since the electrical length of the director is ½λ the surface waves induced by one antenna element 110 on the director will propagate (or radiate) away from the corner of the PCB 120 instead of propagating toward the adjacent antenna, thereby decreasing the mutual coupling between the two antenna elements 110.

As seen in FIGS. 1 and 5, the exemplary MIMO antenna 100 includes eight antenna elements 110 and eight corresponding antenna element mounting locations 130, two of the respective antenna elements 110 and two of the antenna element mounting locations 130 being on each side of the PCB 120. As seen in FIGS. 1 and 5, the antenna elements 110 are mounted towards the corners of the PCB 120. This allows the antenna elements 110 to be close to a, for example, 802.11ac radio port. This placement, reduces the distance between a radio port the and antenna elements 110 relative to other MIMO antennas which allows the MIMO antenna 100 to utilize printed transmission lines 400 to feed the antenna elements rather than more costly coaxial cables.

Figure 6:
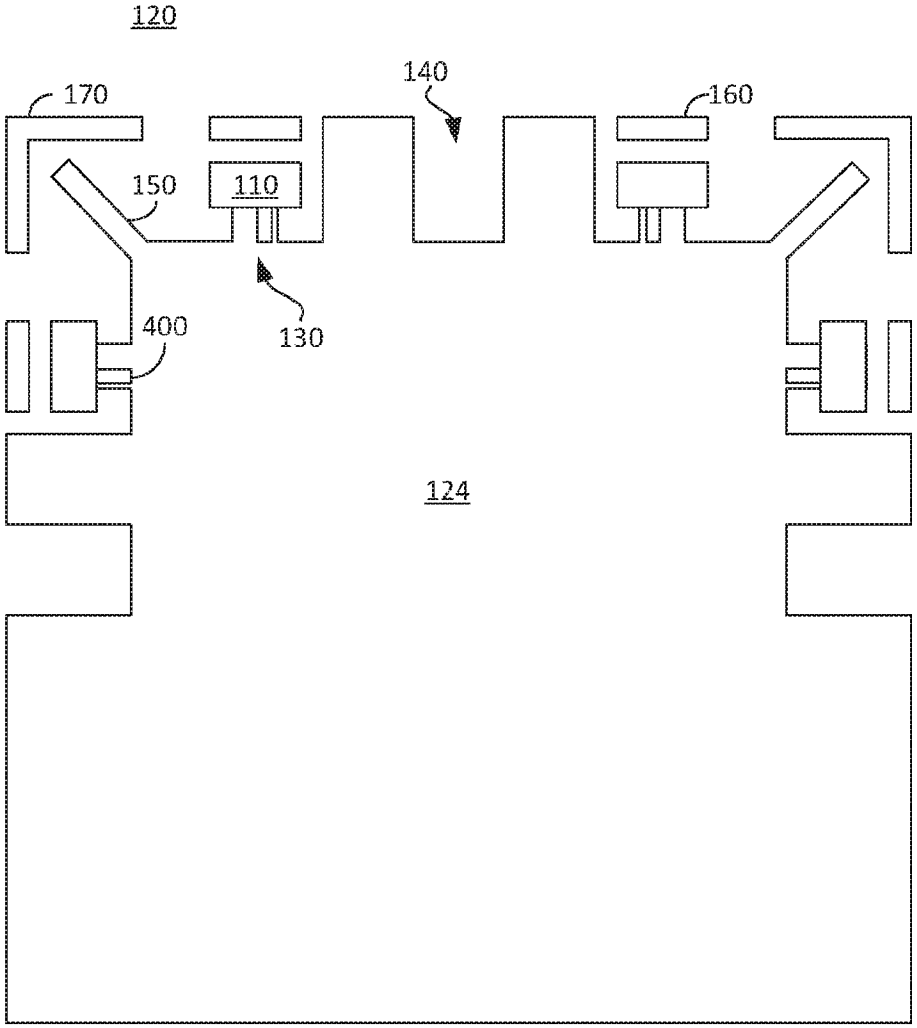
FIG. 6 illustrates another exemplary embedded MIMO antenna, in accordance with an embodiment.
Figure 7:
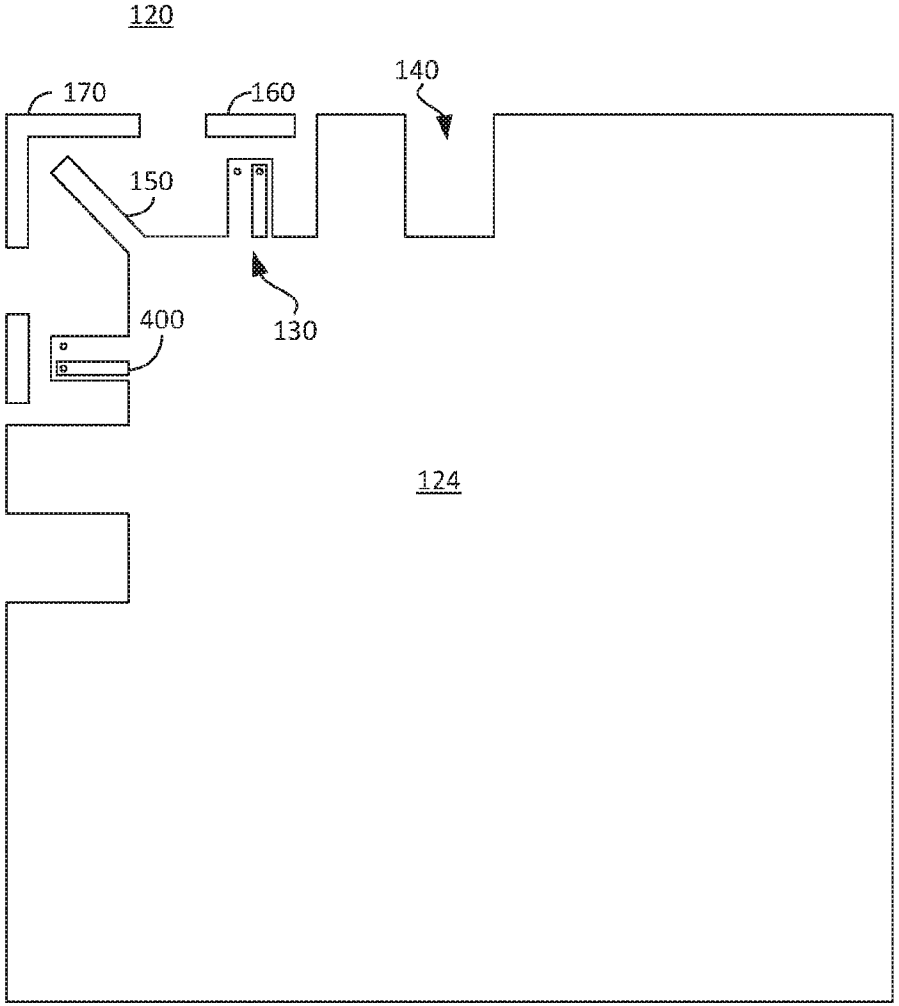
FIG. 7 illustrates yet another exemplary embedded MIMO antenna, in accordance with an embodiment.

As discussed above, a MIMO antenna could be arranged to have 2, 3, 4, 5, 6, 7, or 8 antenna elements 110 depending upon a number of radio ports used in the antenna design. FIG. 6, for example, illustrates a MIMO antenna 600 having four antenna elements 110. FIG. 7, for example, illustrates a MIMO antenna 700 having two antenna elements mounting locations 130 where only two antenna elements 110 could be installed.

One advantage of the embodiments illustrated herein is that the antenna elements 110 are able to be spaced in close proximity, but maintain isolation (mutual coupling) greater than −30 decibels (dB) because of the slots 140, ground stubs 150 and directors 170. Furthermore, the antenna elements 110 and the coupling elements 160 allow the MIMO antenna to have sufficient bandwidth to cover the entire 5 GHz band. The PCB 120, for example, illustrated in FIG. 1 may be ninety millimeters wide by ninety millimeters long. The isolation between the antenna elements could be improved by making the PCB 120 longer or wider, however, enlarging the PCB 120 may increase the overall size of the communication device housing the MIMO antenna 100.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A multiple-input multiple-output antenna, comprising:

a printed circuit board having a plurality of edges, the printed circuit board comprising a ground layer, the ground layer comprising;

a plurality of antenna element mounting locations, at least one of the plurality of antenna element mounting locations being arranged on a first side of the printed circuit board and at least one of the plurality of antenna element mounting locations being arranged on a second side of the printed circuit board;

a plurality of slots comprising dielectric material in a plane of the ground layer, each of the plurality of slots extending a predetermined electrical length from an edge of the printed circuit board; and at least one ground stub, the at least one ground stub comprising an extension of the ground layer of a predetermined electrical length at a predetermined angle relative to the edge of the printed circuit board; and a plurality of dipole antenna elements comprising a balun substantially parallel to a plane of the printed circuit, each of the plurality of antenna elements mounted to the printed circuit board using one of the plurality of antenna element mounting locations, wherein each of the plurality of antenna elements is mounted above the plane of the printed circuit board and less than ¼λ above the plane of the printed circuit board, where λ is an operating frequency of the antenna.

2. The multiple-input multiple-output antenna of claim 1, further comprising a plurality of coupling elements, each coupling element formed from a conductive material, each coupling element having a predetermined electrical length and arranged at an edge of the printed across from one of the plurality of antenna element mounting locations.

3. The multiple-input multiple-output antenna of claim 2, wherein the predetermined electrical length of the plurality of coupling elements is ½λ, where λ is an operating frequency of the multiple-input multiple-output antenna.

4. The multiple-input multiple-output antenna of claim 1, further comprising at least one director, each director formed from a conductive material arranged in an L-shaped and located at a corner of the printed circuit board in the plane of the conductive ground layer, each director having a predetermined electrical length.

5. The multiple-input multiple-output antenna of claim 4, wherein the predetermined electrical length of the plurality of coupling elements is ½λ, where λ is an operating frequency of the multiple-input multiple-output antenna.

6. The multiple-input multiple-output antenna of claim 1, wherein the predetermined electrical length of the plurality of slots is ¼λ, where λ is an operating frequency of the multiple-input multiple-output antenna, each of the plurality of slots configured to reflect ground current induced by the plurality of antenna elements on the ground layer to one of the at least one ground stubs.

7. The multiple-input multiple-output antenna of claim 1, wherein the predetermined electrical length of the at least one ground stub is ¼λ, where λ is an operating frequency of the multiple-input multiple-output antenna.

8. The multiple-input multiple-output antenna of claim 1, each of the plurality of antenna element mounting location comprising:

a printed transmission line configured to receive a radio frequency signal;

a first plated-thru hole galvanically connected to the printed transmission line;

a second plated-thru hole galvanically connected to the ground layer; and a ground coupling element, the ground coupling element configured to capacitively couple to the printed transmission line, the ground coupling element comprising a projection of the ground layer extending a predetermined electrical length on a first side of the printed transmission line.

9. The multiple-input multiple-output antenna of claim 8, each of the plurality of antenna element mounting locations further comprising at least one alignment thru hole, the alignment thru hole galvanically isolated from the ground layer.

10. The multiple-input multiple-output antenna of claim 8, wherein each antenna element comprises:

at least one dipole formed in a single plane;

a first feed pin configured to couple to the first plated-thru hole, the first feed pin formed substantially perpendicular to the single plane of the at least one dipole; and a second feed pin configured to couple to the second plated-thru hole, the second feed pin formed substantially perpendicular to the single plane of the at least one dipole, wherein the balun is arranged at a junction of the at least one dipole and the first and second feed pins, wherein the balun is substantially U-shaped and is formed in the single plane.

11. The multiple-input multiple-output antenna of claim 10, wherein each antenna element is formed from a single sheet of conductive material, wherein the first feed pin and second feed pin are bent.

12. A communication device, comprising:

a printed circuit board having a plurality of edges, the printed circuit board comprising a ground layer, the ground layer comprising;

a plurality of antenna element mounting locations, at least one of the plurality of antenna element mounting locations being arranged on a first side of the printed circuit board and at least one of the plurality of antenna element mounting locations being arranged on a second side of the printed circuit board;

a plurality of slots comprising a dielectric material in a plane of the ground layer, each of the plurality of slots extending a predetermined electrical length from an edge of the printed circuit board; and at least one ground stub, the at least one ground stub comprising an extension of the ground layer of a predetermined electrical length at a predetermined angle relative to the edge of the printed circuit board;

a plurality of dipole antenna elements, each of the plurality of antenna elements comprising a balun substantially parallel to a plane of the printed circuit and configured to couple to one of the plurality of antenna element mounting locations, wherein each of the plurality of antenna elements is mounted above a plane of the printed circuit board and less than ¼λ above the plane of the printed circuit board, where λ is an operating frequency of the antenna;

a plurality of coupling elements, each coupling element formed from a conductive material, each coupling element having a predetermined electrical length and arranged at an edge of the printed circuit board across from one of the plurality of antenna element mounting locations; and at least one director, each director formed from a conductive material arranged in an L-shaped and located at a corner of the printed circuit board in the plane of the conductive ground layer, each director having a predetermined electrical length.

13. The communication device of claim 12, wherein the predetermined electrical length of the plurality of coupling elements is ¼λ, where λ is an operating frequency of the communication device.

14. The communication device of claim 12, wherein the predetermined electrical length of the plurality of coupling elements is ½λ, where λ is an operating frequency of the communication device.

15. The communication device of claim 12, wherein the predetermined electrical length of the plurality of slots is ¼λ, where λ is an operating frequency of the communication device, each of the plurality of slots configured to reflect ground current induced by the plurality of antenna elements on the ground layer to one of the at least one ground stubs.

16. The communication device of claim 12, wherein the predetermined electrical length of the at least one ground stub is ¼λ, where λ is an operating frequency of the communication device.

17. The communication device of claim 12, wherein each of the plurality of antenna element mounting location comprises:

a printed transmission line configured to receive a radio frequency signal;

a first plated-thru hole galvanically connected to the printed transmission line;

a second plated-thru hole galvanically connected to the ground layer; and a ground coupling element, the ground coupling element configured to capacitively couple to the printed transmission line, the ground coupling element comprising a projection of the ground layer extending a predetermined electrical length on a first side of the printed transmission line.

18. The communication device of claim 17, each of the plurality of antenna element mounting locations further comprising at least one alignment thru hole, the alignment thru hole galvanically isolated from the ground layer.

19. The communication device of claim 18, wherein the antenna element comprises:

at least one dipole;

a first feed pin configured to couple to the first plated-thru hole; and a second feed pin configured to couple to the second plated-thru hole, wherein the balun is arranged at a junction of the at least one dipole and the first and second feed pins, wherein the balun is substantially U-shaped.

20. The communication device of claim 19, wherein each antenna element is formed from a single sheet of conductive material, wherein the first feed pin and second feed pin are bent.

* * * * *